US006123002A

United States Patent [19]

Wunderlich et al.

[11] Patent Number: 6,123,002

[45] **Date of Patent: *Sep. 26, 2000**

[54] METHOD AND APPARATUS FOR TRANSVERSE CUTTING

[75] Inventors: Gary R. Wunderlich; Larry D. Wierschke, both of Green Bay, Wis.

[73] Assignee: Paper Converting Machine Company, Green Bay, Wis.

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/724,049

[22] Filed: Sep. 17, 1996

Related U.S. Application Data

[63] Continuation-in-part of application No. 08/223,543, Apr. 6, 1994, Pat. No. 5,557,997.

[51] Int. Cl.[7] ..... B26D 1/58; B26D 7/12

[52] U.S. Cl. ..... 83/37; 83/174; 83/327; 83/329; 83/337; 83/471.3; 83/698.51

[58] Field of Search ..... 83/37, 174, 329, 83/337, 471.1, 471.3, 473, 490, 327, 698.51

[56] References Cited

U.S. PATENT DOCUMENTS

| | | | |
|---|---|---|---|
| Re. 30,598 | 5/1981 | Spencer | 83/14 |
| 1,630,132 | 5/1927 | Molins . | |
| 1,746,594 | 2/1930 | Jacobson | 83/471.3 |
| 1,784,443 | 12/1930 | Hohn | 83/329 |
| 1,846,942 | 2/1932 | Bronander et al. . | |
| 2,093,323 | 9/1937 | Lamoreaux . | |
| 2,140,720 | 12/1938 | Ruau | 83/329 |
| 2,704,560 | 3/1955 | Woessner | 83/473 |
| 2,752,999 | 7/1956 | Gage . | |
| 2,769,600 | 11/1956 | Kwitek et al. . | |
| 2,833,024 | 5/1958 | Boehm et al. | 83/329 |
| 3,213,731 | 10/1965 | Renard . | |
| 3,213,734 | 10/1965 | Nystrand . | |
| 3,218,898 | 11/1965 | Briscoe | 83/337 |
| 3,292,470 | 12/1966 | Nystrand et al. . | |
| 3,380,331 | 4/1968 | Boothe, Jr. et al. | 83/490 |
| 3,905,260 | 9/1975 | Nystrand | 83/155 |
| 4,041,813 | 8/1977 | Spencer | 83/14 |
| 4,052,048 | 10/1977 | Shirasaka | 270/40 |
| 4,173,846 | 11/1979 | Steiner et al. | 91/248 |
| 4,347,771 | 9/1982 | Bradley | 83/174 |
| 4,584,917 | 4/1986 | Blom | 83/174 |
| 4,914,997 | 4/1990 | Belvederi | 83/156 |
| 5,152,203 | 10/1992 | Wierschke | 83/13 |
| 5,289,747 | 3/1994 | Wunderlich | 83/38 |
| 5,315,907 | 5/1994 | Biagiotti | 83/38 |
| 5,557,997 | 9/1996 | Wunderlich et al. | 83/174 |

FOREIGN PATENT DOCUMENTS

| | | | |
|---|---|---|---|
| 930737 | 7/1955 | Germany . | |
| 248415 | 3/1926 | United Kingdom . | |
| 307153 | 3/1929 | United Kingdom . | |
| 337225 | 10/1930 | United Kingdom . | |
| 452180 | 8/1936 | United Kingdom | 83/490 |

*Primary Examiner*—Rinaldi I. Rada
*Assistant Examiner*—Charles Goodman

[57] ABSTRACT

A method of operating an orbital saw to transversely sever superposed elongated web plies into shorter length products which includes advancing along a linear path superposed elongated web plies having a cross sectional area of at least about 3.5 square inches (2200 mm$^2$), providing a 4-bar linkage including first and second bars extending generally parallel to each other and third and fourth bars connecting the first and second bar means adjacent the ends thereof, further providing a disc blade rotatably mounted on each of the third and fourth bars, rotating the first bar about a first axis to orbit the blades with the blade orbit intersecting the linear path with the centers of said disc blades being at least 30 inches (750 mm) apart while skewing the first axis at a minor acute angle to the linear path, connecting the first and the second bar with the third and fourth bar to provide at least one degree of pivotal freedom of the third and fourth bars relative to the first and second bars, and rotating the second bar about a second axis different from the first axis to compensate for the skewing and to orient the disc blades perpendicular to the web plies in the linear path when severing the web plies.

13 Claims, 9 Drawing Sheets

FIG. 1
PRIOR ART
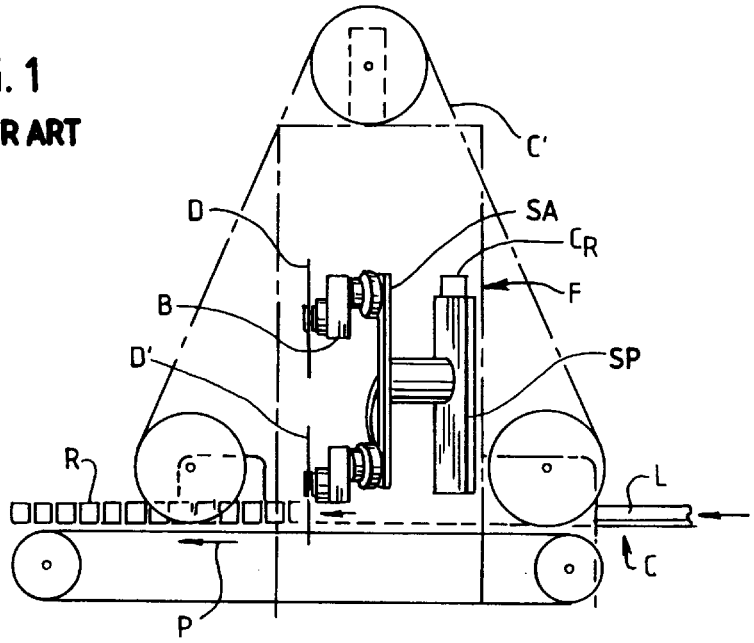
FIG. 2
PRIOR ART
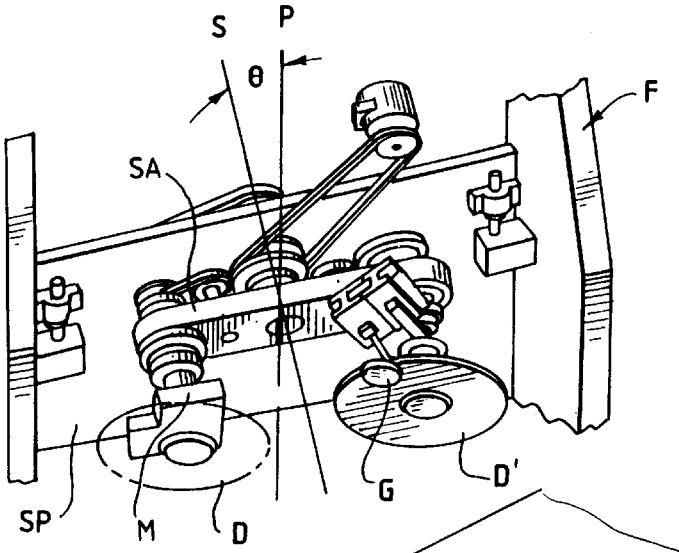
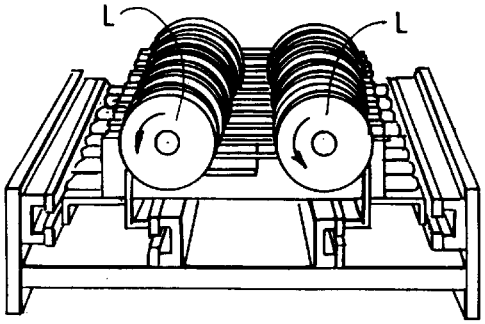
FIG. 3
PRIOR ART
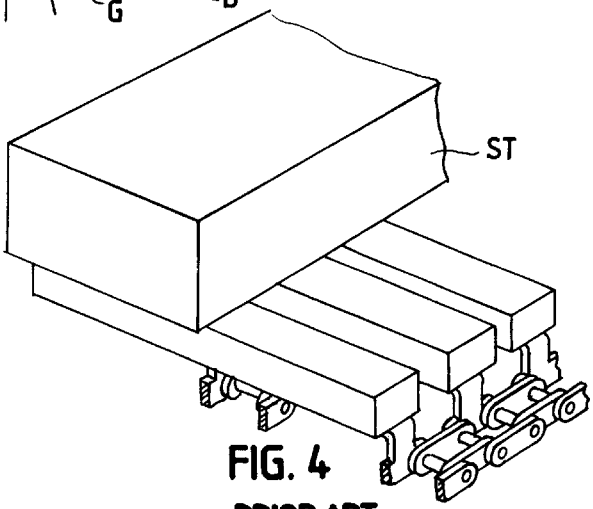
FIG. 4
PRIOR ART FIG. 7
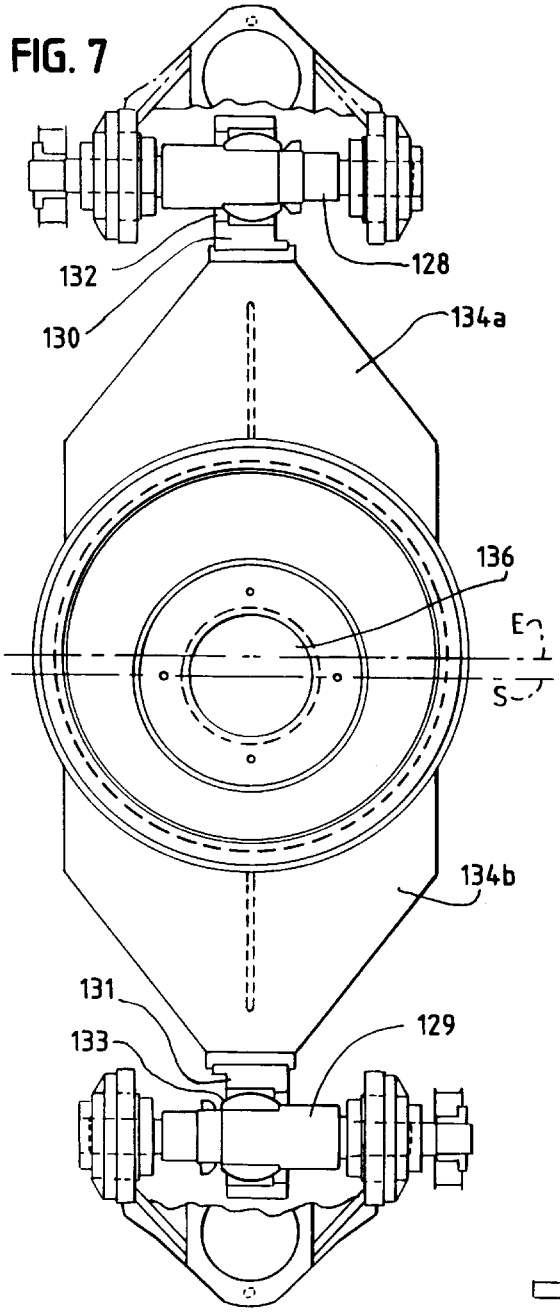
FIG. 8
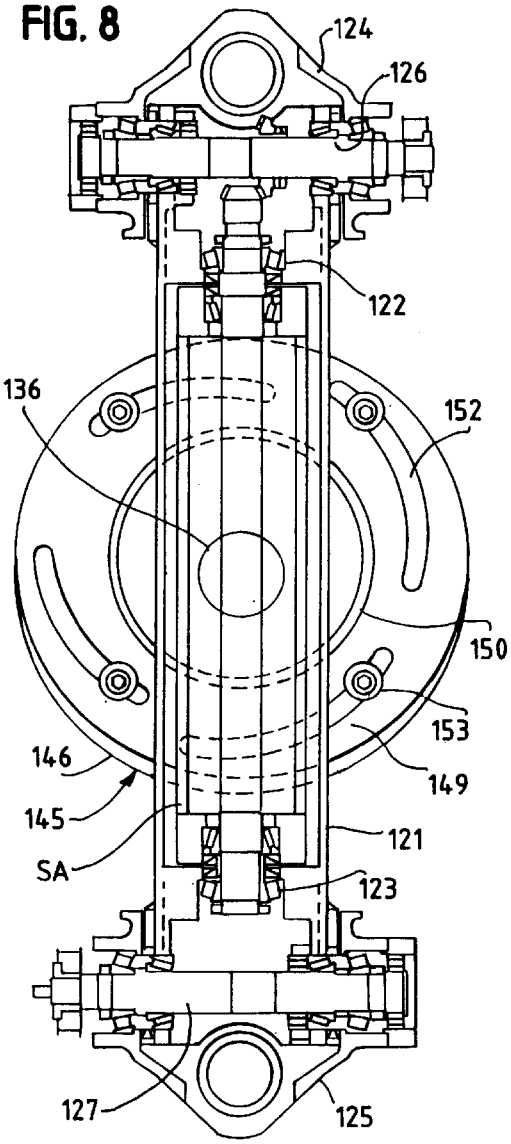
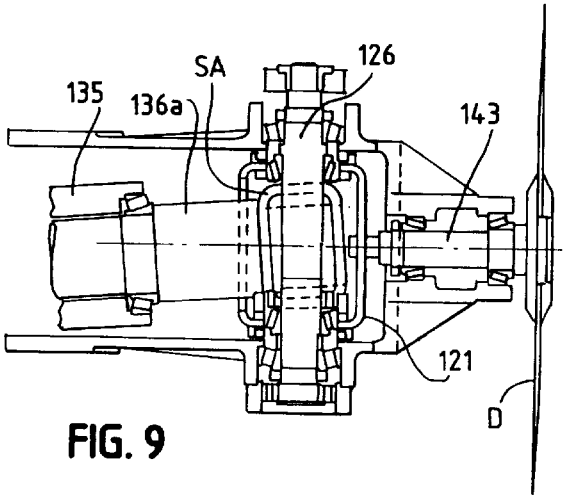
FIG. 9

METHOD AND APPARATUS FOR TRANSVERSE CUTTING

This application is a continuation-in-part of application Ser. No. 08/223,543, filed Apr. 6, 1994, now U.S. Pat. No. 5,557,997.

BACKGROUND AND SUMMARY OF INVENTION

This invention relates to a method and apparatus for transverse cutting of multi-ply web material and, more particularly, to a continuous motion saw. A continuous motion saw is designed to cut a product in motion. Illustrative products are "logs" of bathroom tissue and kitchen toweling, and bolts or continuous superposed plies of facial tissue, interfolded or otherwise.

The illustrative products, for example, are produced at high speed on machines termed "reminders". These machines start with a parent roll perhaps about 10 feet (2.3 meters) long and about 8 feet (1.9 meters) in diameter—resulting from the output of a paper-making machine. The parent roll is unwound to provide a web which can be transversely perforated and then rewound into retail size rolls of at least 3.5 inches (89 mm) in diameter for bathroom tissue and kitchen toweling, viz. a cross-sectional area of 9.6 $in^2$ (6190 $mm^2$). Conventional high speed automatic rewinders can produce upwards of 30 logs per minute. These logs then are delivered to a log saw where they are moved axially for severing into retail size lengths. In the case of facial tissue, the product may be continuous (as in co-owned U.S. Pat. No. 4,052,048) and this also requires transverse cutting at regular intervals. In this case, the minimum cross-sectional area is at least 3.5 $in^2$ (2200 $mm^2$).

Saws for making bathroom tissue, kitchen toweling, etc. started being used in the middle 1950s principally for toilet tissue and have come to be known as "log saws". Prior to that time, the retail size rolls were made by slitting the web on the rewinder. For example, spaced slitting wheels are shown operating against a slitting roll in co-owned U.S. Pat. No. 2,769,600. This proved unsatisfactory. When the wide web being processed had holes stemming from manufacture on the paper machine, slitting would cause at least one of the narrower webs to jam the rewinder. This required shutdown and cleaning out the jam. To avoid this recurring problem of dealing with "fish-eyes" in the web, the web was rewound as a log. So, to cut the log into the retail size lengths, a log saw was needed.

The first commercially successful log saw was the "Gilbertville" saw of Gage, U.S. Pat. No. 2,752,999. This saw operated intermittently—swinging downwardly and upwardly (in knife-like fashion) against the log which was indexed a product length (4½" for bathroom tissue) while the saw disc was lifted upwardly away from the log path. Sharpening of the saw disc occurred also when the disc was upwardly out of the log path.

The next commercially successful log saw is seen in co-owned U.S. Pat. No. 3,213,731. This differed from the Gilbertville saw in having the saw disc move through an orbit—passing through the log or logs at the nadir of the orbit. Sharpening occurred when the disc was upwardly out of the path. However, as with the Gilbertville saws, the operation was still intermittent—only having the saw cut the log after it had been indexed the appropriate distance.

The next major development was in the mid-1970s with the use of the continuous motion (CM) saw as seen in co-owned U.S. Pat. No. 4,041,813. This differed in two major respects from the prior log saws. The log was advanced continuously and the saw was orbited continuously. This was achieved by having the orbit axis skewed relative to the path of log travel. The angle of skew was of the order of a few degrees—sufficient to accommodate the space in between cuts. After the '813 patent was granted, the German counterpart was rejected on art relating to cigarette making machines. Thereafter, the '813 patent was reissued as RE. 30,598. Representative of the cigarette making machine were U.S. Pat. Nos. 1,630,132 and 1,846,942.

The next commercial machine did not appear until the early 1990s as seen in U.S. Pat. No. 5,315,907. This was stated to be an improvement on the '813 patent. It did not utilize any of the teachings of the cigarette-making machine publication. In the competitive '907 patent, the saw head was reciprocated parallel to the log length between cuts.

The instant invention makes use of a 4-bar linkage somewhat analogous to that of the cigarette-making machines of the 1920s which heretofore had not been considered applicable to log saws. For example, a log saw disc blade has an orbit diameter of at least about 30 inches (750 mm) while the blade (not necessarily a disc) of a cigarette machine has an orbit diameter of about 6" (150 mm). A more significant difference resides in the product. In converted paper products, the cross-sectional area is at least 3.5 $in^2$ (2400 $mm^2$) while cigarettes have a cross-sectional area of about 0.07 $in^2$ (45 $mm^2$). So, the instant invention builds on the concept of the '813 patent which has been satisfactory in handling the conventional high speed automatic rewinders which produce upwards of 30 logs per minute. However, the '813 saw was not readily alterable to provide different length products.

For product length change, the skew angle had to be changed. This required replacement of the blade mounting and drive components. In particular, the angle of the block mounting of the blade had to be changed to return the blades back to perpendicular and the beveled gears inside it—that were used to drive the blade—had to be changed to continue to match the angled housing. With the inventive saw, there is no such onerous replacement. For that matter, there was a complicated routine involved in product length change in the competitive saw of the '907 patent.

According to the inventive method of operating an orbital saw to transversely sever superposed elongated web plies into shorter length products, the first step is to advance superposed elongated web plies along a linear path, then providing a 4-bar linkage including first and second bar means extending generally parallel to each other and third and fourth bar means or brackets connecting the first and second bar means adjacent the ends thereof, further providing a disc blade rotatably mounted on each of the third and fourth bar means with each of the third and fourth bar means being equipped with means for rotating the disc blades, then rotating the first bar means of the 4-bar linkage about a first axis to orbit the blades with the blade orbit intersecting the linear path with the centers of the disc blades being at least 36" (914 mm) apart, while skewing the first axis at a minor acute angle to the linear path, connecting the first and second bar means with the third and fourth bar means to provide at least one degree of pivotal freedom of the third and fourth bar means relative to the first and second bar means, and rotating the second bar means about a second axis different from the first axis to compensate for the skewing and also to orient the disc blades perpendicular to the web plies in the linear path when severing the web plies.

The invention is described in conjunction with illustrative embodiments in the accompanying drawing.

BRIEF DESCRIPTION OF DRAWING

Sheet 1

FIG. 1 is a schematic side elevational view of a continuous motion saw according to the prior art;

FIG. 2 is a fragmentary perspective view of a continuous motion saw according to the prior art;

FIG. 3 is a fragmentary end elevational view of the prior art product conveyor arranged for advancing logs;

FIG. 4 is a view similar to FIG. 3 but arranged for advancing facial tissue;

Sheet 2

Figure 5:
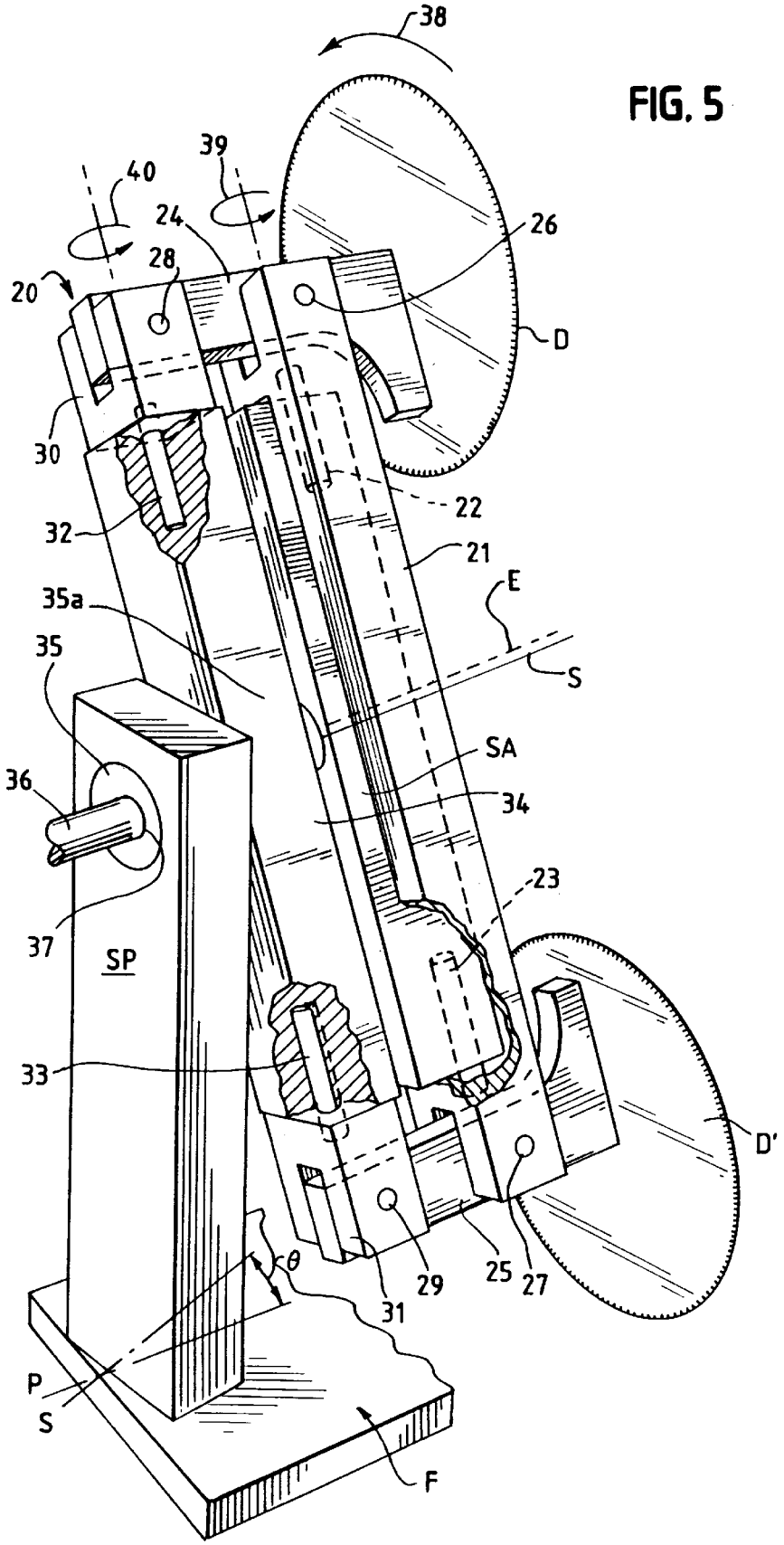

FIG. 5 is a schematic perspective view of a model featuring the teachings of a first embodiment of the invention;

Sheet 3

Figure 6:
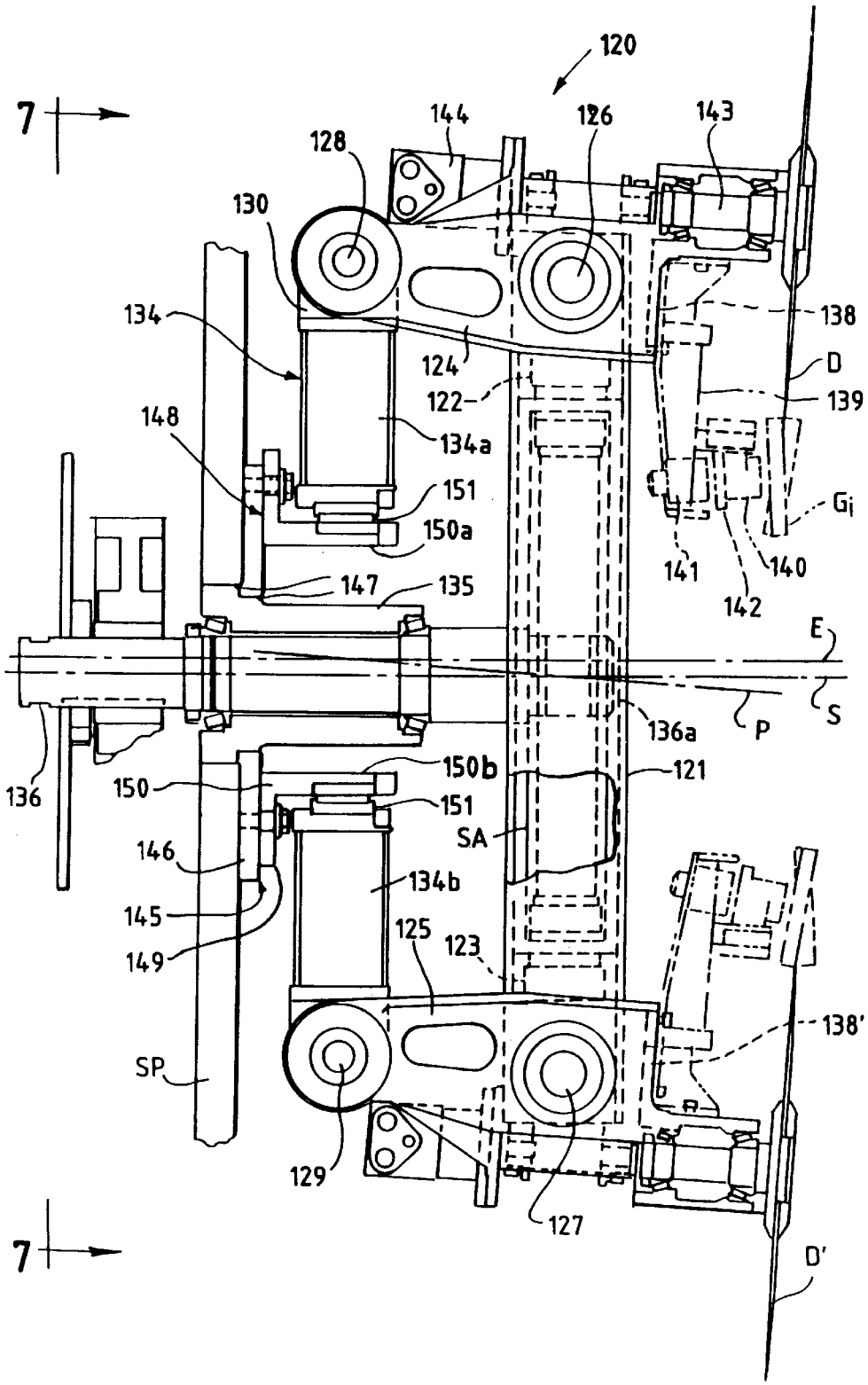

FIG. 6 is a plan view of a commercial embodiment of the first embodiment of the inventive saw;

Sheet 4

FIG. 7 is an end view of the saw as seen along the sight line 7—7 of FIG. 6;

FIG. 8 is an opposite end view of the saw of FIG. 7;

FIG. 9 is a side elevational view of the saw of FIG. 8;

Sheet 5

Figure 10:
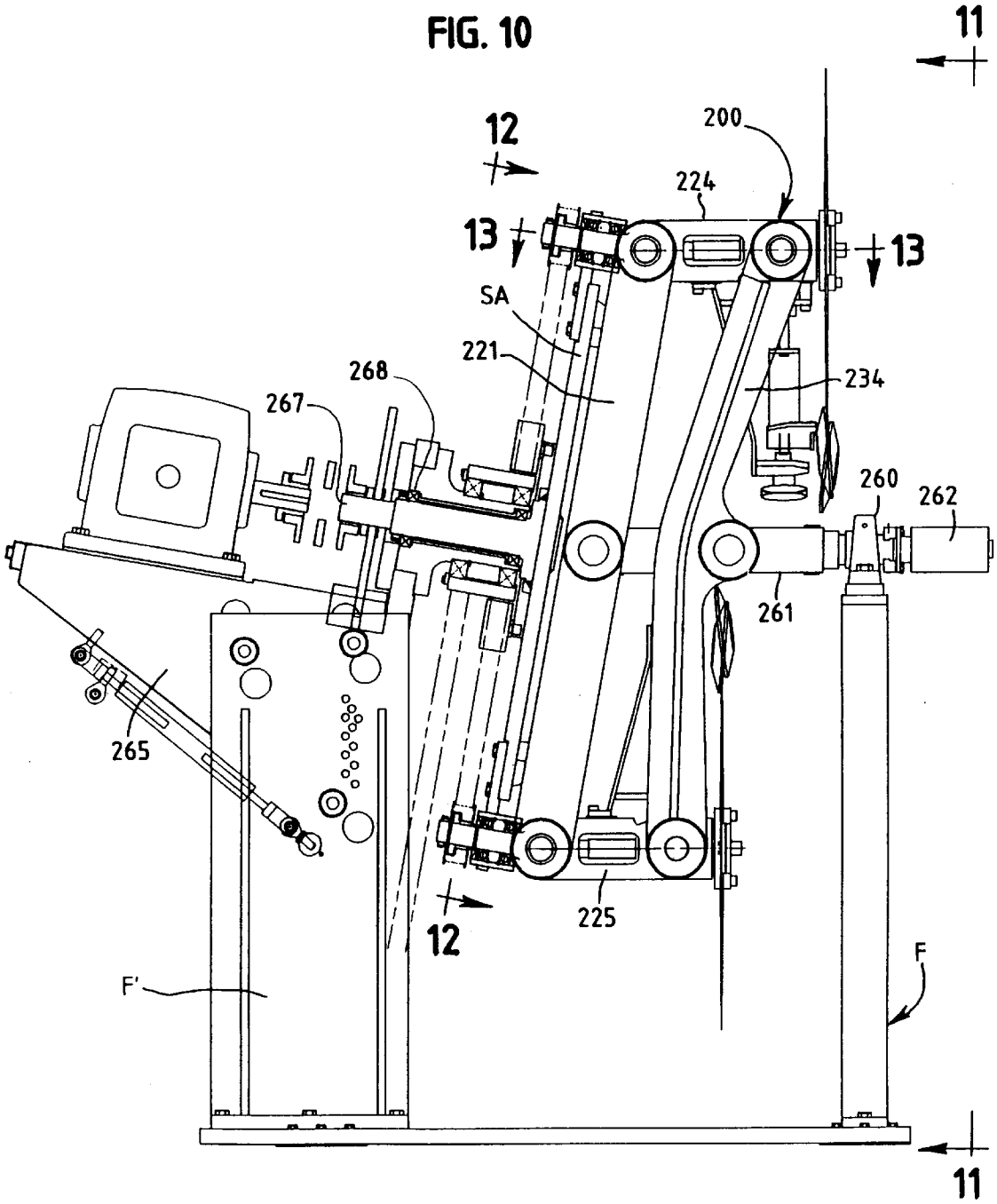

FIG. 10 is a fragmentary side elevational view of a second embodiment of the invention;

Sheet 6

Figure 10A:
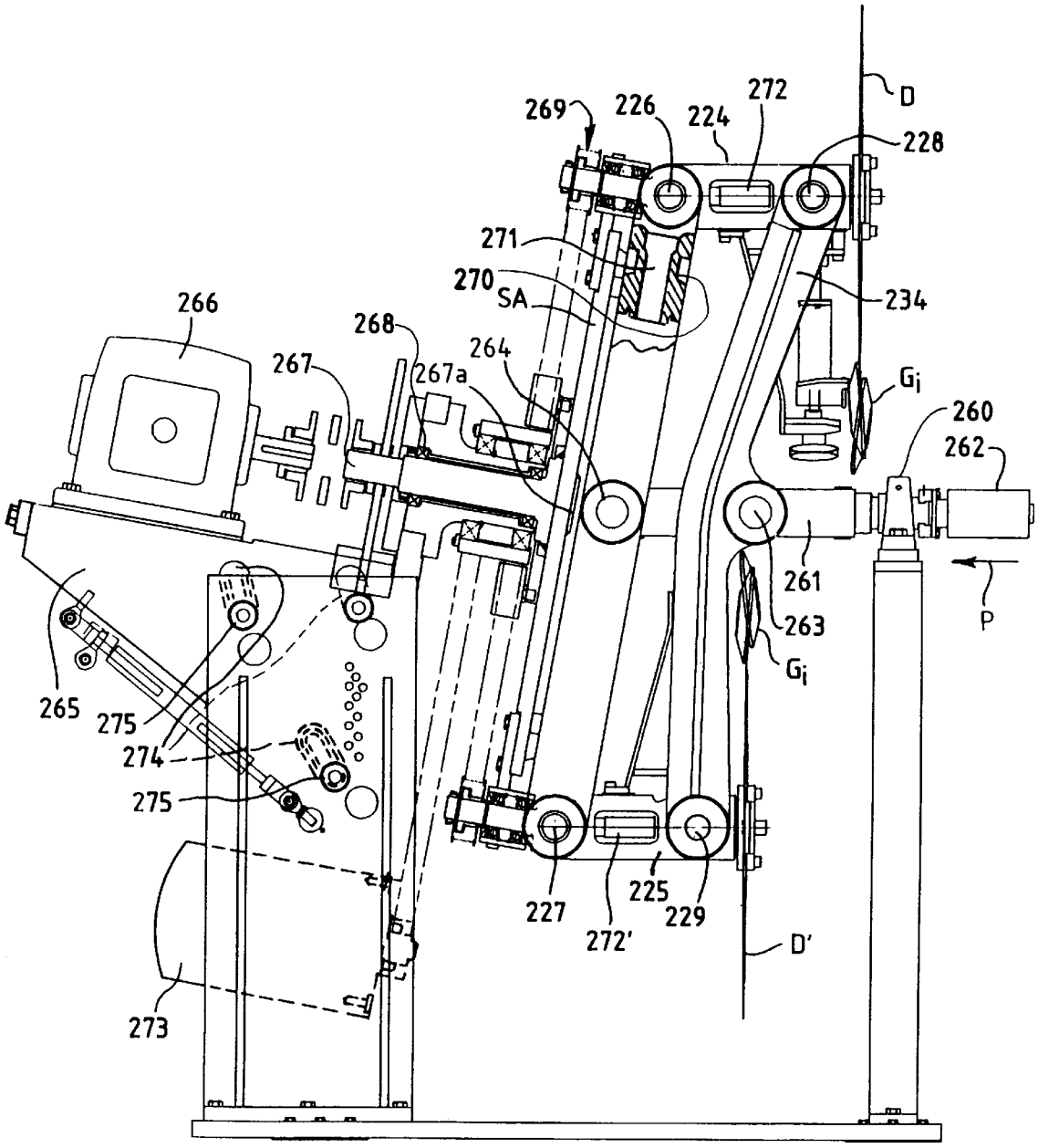

FIG. 10A is a view similar to FIG. 10 but enlarged and more detailed;

Sheet 7

Figure 11:
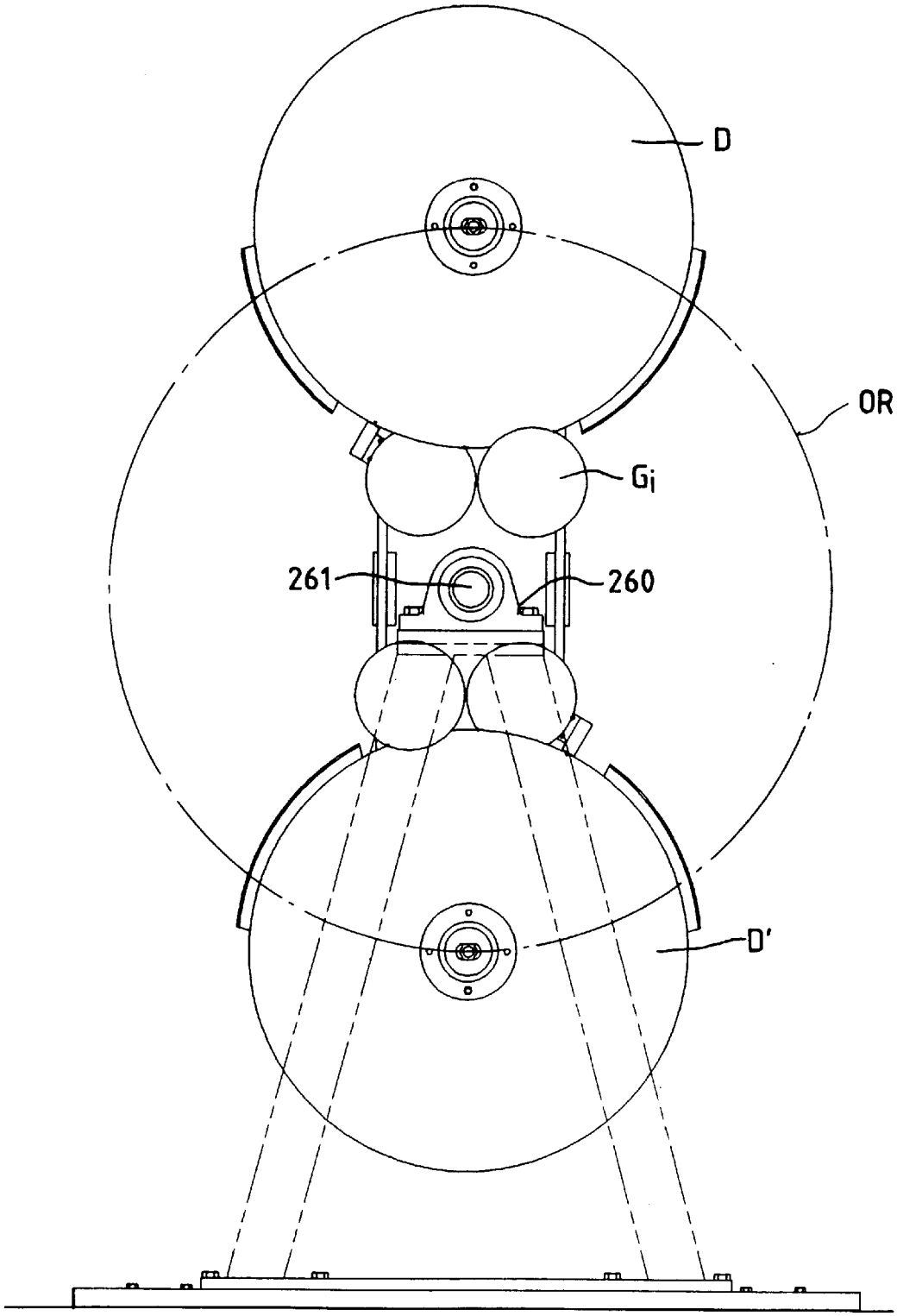

FIG. 11 is an end elevational view of the embodiment of FIG. 10 as seen along the sight line 11—11 of FIG. 10;

Sheet 8

Figure 11A:
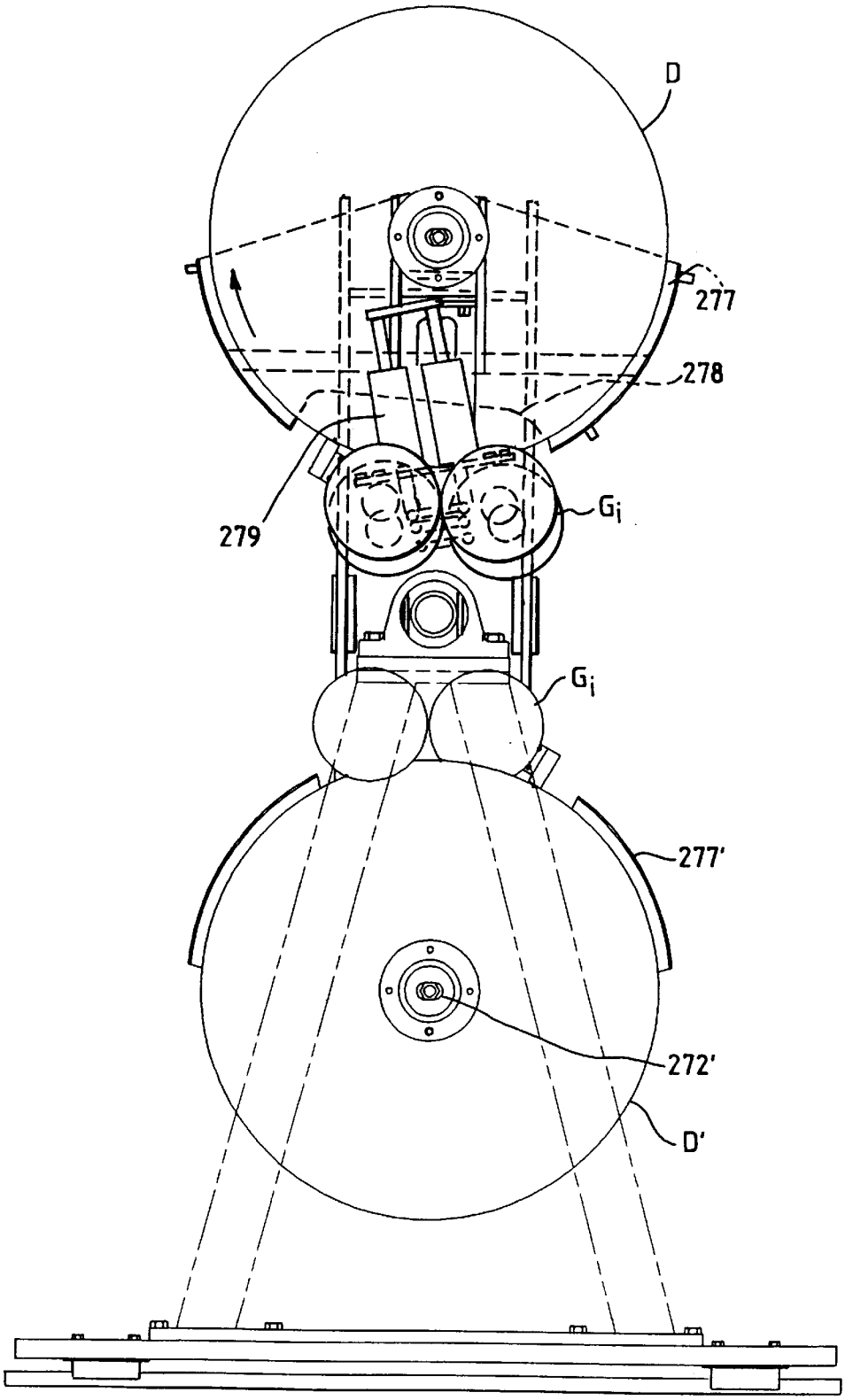

FIG. 11A is a view similar to FIG. 11 but showing additional details.

Sheet 9

Figure 12:
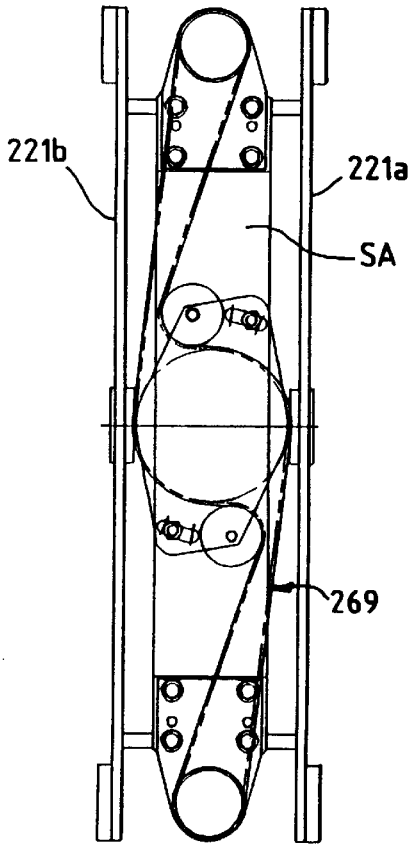
Figure 13:
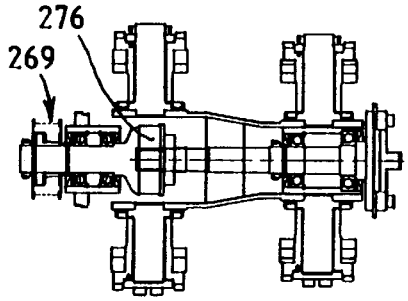
Figure 13A:
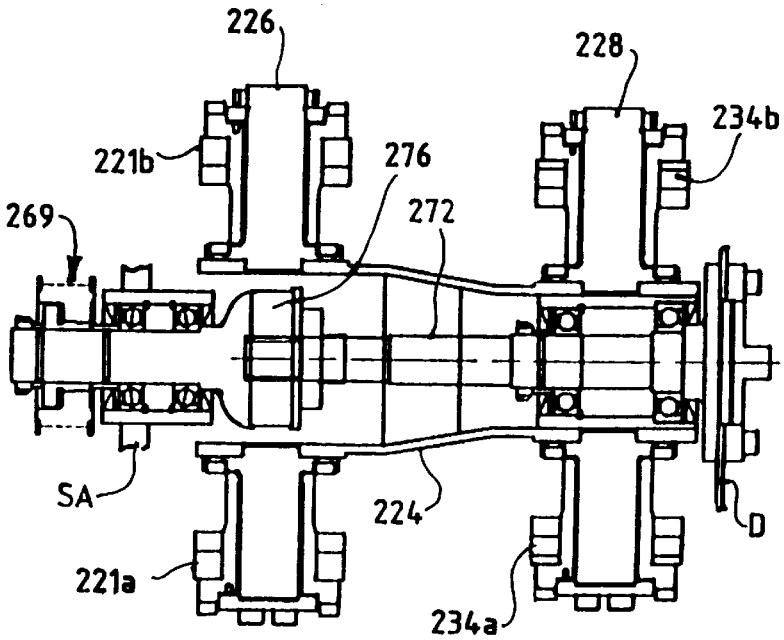

FIG. 12 is an opposite end elevational view as seen along the sight line 12—12 of FIG. 10;

FIG. 13 is a top plan view as seen along the sight line 13—13 of FIG. 10; and FIG. 13A is a view similar to FIG. 13 enlarged and but featuring additional details.

DETAILED DESCRIPTION

Prior Art

Referring first to FIG. 1 the symbol F designates generally the frame of the machine which can be seen in FIG. 2 to include a pair of side frames.

The frame F provides a path P which extends linearly, horizontally for the conveying of logs L and ultimately the severed rolls R. The logs and thereafter the rolls are conveyed along the path P by a suitable conveyor generally designated C. The symbol M designates generally the blade support mechanism which includes two disc blades D, D'—see also FIG. 2. As can be seen from FIG. 2, there is provided a bracket for each blade as at B which support the usual grinders G. The blades D, D' and their associated structure are carried by a skew plate SP which supports the skew arm SA for rotation about a skew axis S which is arranged at a minor acute angle θ to the path P (see the upper central portion of FIG. 2).

FIGS. 3 and 4 illustrate the two principal products handled by the CM saw. In both cases, the conveyor C has upper and lower runs to confine the entering material and issuing product top and bottom. For example, relative to the logs L seen in FIG. 3, a detailed description of the conveyor C can be found in the above-mentioned '813 patent. There, it was pointed out that the triangular configuration of the conveyor chains—see the designation C' in FIG. 1—avoids any interference of the return run of upper chains with the cutting mechanism. The same arrangement has been used for stacked tissues ST as illustrated in FIG. 4—the difference being the shape of the conveyor cross bars confronting the material being introduced into the saw station and the product issuing therefrom. In FIG. 4, the cross bars are flat rather than cylindrically contoured as in FIG. 3.

First Embodiment of the Invention

The invention is first described in conjunction with a first embodiment model in FIG. 5. This permits the description of the basic components free of many of the details present in the commercial machine of FIGS. 6–9.

It will be appreciated that the commercial machine like the model makes use of a 4-bar linkage. To the best of applicants' knowledge, this type of mechanism has not been used in the paper converting industry notwithstanding the long availability of such four bar types in cigarette machines—see, for example, the above-cited U.S. Pat. Nos. 1,630,132 and 1,846,942. The normal cigarette rod, in contrast to converted paper products, has a cross sectional area of about 0.7 square inches (45 $mm^2$).

In FIG. 5, the symbol F again designates generally a frame which provides a support for the skew plate SP. As before, the skew plate SP carries the skew arm SA which in turn ultimately provides a support for orbiting, rotating disc blades D, D'. As can be appreciated from what has been said before, here the similarity ends between the invention and the prior art. In particular, there is considerably more involved in compensating for the skew angle θ between the axis S of the rotation of skew arm SA and the path P. Instead of having the blades D, D' of FIG. 5 fixed at the compensating angle θ as were the disc blades D, D' in FIGS. 1 and 2, the invention makes the compensation in this first embodiment by employing pivotal connections providing two degrees of pivotal freedom and an eccentric. For example, the prior art machine utilized brackets B that were angled and then orbited with a planetary motion so as to maintain the disc blades D, D' always perpendicular to the path P.

Here, the invention makes use of a 4-bar linkage generally designated 20 having at least one degree of freedom versus the planetary mechanism of the prior art log saw. This linkage includes an arm-like first bar 21 which is pivotally connected as at 22, 23 to the ends of the skew arm SA. In turn, the clevis-like ends of first bar 21 are pivotally connected to third and fourth bars or brackets 24 and 25 via transversely-extending pivot rods 26, 27—just to the left of blades D, D'. At their ends opposite the blades D, D', the third and fourth bars 24, 25 are pivotally connected via transversely-extending pivot rods 28, 29 to the clevises 30, 31—see the left side of FIG. 5. These clevises, in turn, are pivotally connected via longitudinally-extending pivot posts 32, 33 to the second bar 34. Thus, the 4-bar linkage includes first bar 21, second bar 34, third bar 24 and fourth bar 25.

Mounting of 4-Bar Linkage

Both the skew arm SA (and therefore, the first bar 21) and the second bar 34 are rotatably mounted relative to the skew plate SP—and therefore the frame F. For this purpose, the skew plate SP is equipped with a bearing 35 in which a drive shaft 36 is journaled eccentrically as at 37 and revolving on axis S. The shaft 36 is fixedly connected to the skew arm SA while the bearing 35 extends into the second bar 34—which is rotatably mounted thereon establishing axis E. So, the second bar 34 is eccentrically mounted relative to the drive shaft 36 and can be considered a control arm to correct for the skew angle.

Inasmuch as the skew arm SA is fixedly connected to the drive shaft 36 and perpendicular thereto—it rotates in a plane which is skewed relative to the path P, i.e., it is perpendicular to the axis S. This also applies to the first bar 21. But the second bar 34 rotates in a plane perpendicular to the path P and thus compensates for the skew angle θ and positions the blades D, D' perpendicular to the path P so as to provide a "square" cut. But, unlike the prior art '813 patent, this is not done by making a single compensation (via mounting blocks in the mechanism M), but is done by using an eccentric plus connections that provide at least two degrees of rotational or pivotal freedom. This can best be appreciated from a description of what happens when the upper one of the blades D, D travels in the direction of the arrow 38 from a 3 o'clock position—as in the right hand portion in FIG. 5—to the 6 o'clock position.

Operation

As a blade D orbits from the 3 o'clock position toward cutting contact with a log, the first bar 21 pivots relative to the skew arm SA—this on the pivot posts 22, 23 as indicated by the arrow 39. At the 3 o'clock position, the descending end of the second bar 34 is in its furthest position from the skew axis S, i.e., the axis of the drive shaft 36. This can be appreciated from the location of the eccentric bore 37—see the left side of FIG. 5. Then, as the second bar 34 continues to rotate—by virtue of being coupled to the skew arm SA, through third and fourth bars 24, 25 and first bar 21—the descending end of the second bar 34 comes closer and closer to the skew axis S, and is closest at the 9 o'clock position. The other end of the second bar or control arm 34 follows the same pattern.

What this means is that the contribution of the eccentric mounting of the second bar 34 toward compensating for skew varies, i.e., decreases in going from the 3 o'clock position to the 9 o'clock position. This results in the second bar 34 pulling the third bar 24 about the pivot post 32. This pivot post is in the clevis 30 and the third bar 24 and the movement is designated by the arrow 40.

This necessarily occurs because the second bar 34, the clevis connection 30, the third bar 24, the first bar 21 (with skew arm SA), fourth bar 25 and clevis 31 form, in essence, a generally planar four-bar linkage. This also includes the pivots 28, 26, 27 and 29 in proceeding clockwise around the four-bar linkage. And this linkage is fixed in the plane of rotation just described because the downstream end of the shaft 36 is fixed to the skew arm SA which in turn is fixed against longitudinal movement in the first bar 21. Thus, the pivots 22, 23, 32, 33 are generally parallel to the length of the first bar 21 and the pivots 26, 27, 28 and 29 are generally perpendicular to the linkage plane.

However, at the same time, there is a rotation about the longitudinally-extending pivot posts 22, 23 at the ends of the skew arm 12 and also the counterpart longitudinally-extending pivot posts 32, 33 at the ends of the second bar 34. This necessarily occurs because the eccentric mounting of the second bar 34 on the bearing 35 produces a rectilinear movement of the second bar 34, i.e., a movement that has both "horizontal" and "vertical" components.

This extra component results in a twisting of the drive or first bar 21 (permitted because of the pivotal connection with the skew arm SA) and which is reflected in changing the orientation of the third and fourth bars 24, 25 and, hence the blades D, D'. So the inventive arrangement compensates for the departure of the blades from "squareness" by virtue of being skewed by the eccentricity of the drive shaft 36 and its coupling to the four-bar linkage. There are other ways of pivotally coupling the various members of the four-bar linkage—in particular, substituting at least a universal or spherical joint for the pivots 28, 32 and 29, 33.

The invention has been described thus far in connection with a schematic model. Now the description is continued in connection with a commercial version of the first embodiment—this is connection with FIGS. 6–9.

Embodiment of FIGS. 6–9

Looking at FIG. 6 in the lower left hand portion, it will be seen that the symbol SP again designates the skew plate which is shown fragmentarily. This has rigidly fixed therein the bearing 135 (see the central portion of FIG. 6) which rotatably, eccentrically carries the drive shaft 136. Affixed to the right hand end of drive shaft 136, as at 136*a*, is the skew arm SA—seen in solid lines in the broken away portion of the first bar 121 of the 4-bar linkage 120. As with the model of FIG. 5, the symbols P, S and E refer respectively to the product path, the skew, and the eccentric.

As before, there are pivot post connections between the skew arm SA and first bar 121 as at 122 at the top and 123 at the bottom. At its upper end, the first bar 121 is equipped with a transversely extending pivot rod as at 126 and which connects the first bar 121 to the upper bracket or third bar 124. In similar fashion, the pivot rod 127 connects the lower end of the first bar 121 to the lower bracket or fourth bar 125.

Now considering the left hand end of the third bar 124 (in the upper left hand portion of FIG. 6), the numeral 128 designates a transversely extending pivot rod pivotally attached to bearing housing 130 mounted on a longitudinally-extending pivot 132 (see FIG. 7) carried by the upper end portion 134*a* of the second bar generally-designated 134. In similar fashion, the numeral 129 designates a transversely extending pivot rod attached to the bearing housing 131 (see FIG. 7) mounted on a longitudinally-extending pivot 133 carried on the lower end portion 134*b*. Here, it will be noted that the second bar 134 is somewhat different from the straight bar 34 of the model of FIG. 5 in that it has two parts 134*a* and 134*b*, each associated with a different third and fourth bar as seen in FIG. 6—124 at the upper end 134*a* and 125 at the lower end 134*b*. In between, the parts are connected by a spherical bearing to accommodate the eccentric means as seen in FIG. 7—to be described in greater detail hereafter.

Now returning to FIG. 6, it will be seen in the upper right hand corner that there is a mounting surface 138 provided at the work end of the third bar 124. This carries the grinder or sharpening means $G_i$ associated with the upper disc blade D. In similar fashion, another surface 138' is provided in the lower right hand portion of FIG. 6 for carrying the sharpening means for the other blade D'. Because the constructions are the same for the upper and lower grinders and disc blades, only the one shown in the upper position in FIG. 6 will be described.

Boltably secured to the surface 138 is a bracket or arm member 139. This carries a bearing 140 which in turn rotatably carries a shaft for the grinding stones $G_i$. A pair of motors, one of which is shown at 141, power the grinding stones $G_i$ to provide a beveled edge for the upper disc blade D. A suitable installation is seen in either of co-owned U.S. Pat. Nos. 5,152,203 and 4,347,771 and reference may be had thereto for additional details. Advantageously, these stones are operated intermittently—as by being brought into contact with their associated blade only when sharpening is indicated. For this purpose, a control actuated shifting mechanism 142 is carried by the bracket 139. This controlling is normally done by a schedule developed for a specific installation and product.

Referring to FIG. 9, the blade D is carried by a spindle or shaft 143 and is rotated by a motor 144—also see FIG. 6. Further details of this embodiment may be seen in co-owned application Ser. No. 08/223,543 filed Apr. 6, 1994, now U.S. Pat. No. 5,557,997.

Eccentric Compensator

In the central left hand portion of FIG. 6, the numeral 145 designates generally the assembly of elements which provide the eccentric which compensates for the skew. These include a plate 146 which is secured to the skew plate SP by the circular welds 147.

Positionably mounted on the plate 146 is an eccentric bearing generally designated 148. The bearing 148 is annular and has a flange portion as at 149 confronting the plate 146 and a cylindrical-like portion 150 which surround the bearing 135 in spaced relation thereto.

That the bearing 148 is eccentric to the bearing 135 can be appreciated from the fact that the upper portion as at **150*a* (still referring to the central portion of FIG. 6) is further from bearing 135 than is the lower portion 150*b***.

Interposed between the cylindrical portion 150 and the second bar 134 is a ring bearing as at 151. Thus, when the second bar 134 is moved by the bars 124, 125 under the force exerted by the rotating arm SA and bar 121, the upstream or power ends of the third and fourth bars 124, 125 move in an eccentric fashion. Thus far, the structure described is the counterpart of that previously described in conjunction with FIG. 5 where the second bar 34 has its ends following an eccentric path based upon the eccentricity of the bearing 35 relative to the drive shaft 36, viz., the difference between axes E and S in FIGS. 5 and 6. The second bar 34 is journaled on the bearing 35 for free rotation thereon—and this can be appreciated from the fact that the bearing 35 continues through the fourth bar 34 as can be appreciated from the portion of the bearing designated **35*a* in FIG. 5—see the right central portion of FIG. 5**. Added to the commercial embodiment is the ability to adjust the eccentricity.

Eccentric Adjustment

The adjustable feature for the eccentric 145 can be best appreciated first from a consideration of FIG. 8. There, it is seen that the flange or hub portion 149 is equipped with four arcuate slots 152, each of which receives a cap screw 153. The cap screws are further received within tapped openings in the plate 146 and when the cap screws are loosened, the hub or flange portion 149 of the bearing 148 can be "dialed" to the desired position and thus change the eccentricity of the second or control bar 134. It will be appreciated that the rotation of the eccentric could be achieved by pushbutton means using automatic clamp bolts at 153 and means for turning the flange 149. Thus, adjustment could be done while the saw is operating, using further means for turning the skew plate SP to the new skew angle. The curved slots 152 produce an 8:1 movement to reaction versus a basic linear displacement of the eccentric being 1:1.

Second Embodiment

The invention can be practiced with a more economical embodiment—as illustrated in FIGS. 10–13 and 10A–13A. Here, again, like numerals are used for similar functioning parts—but increased to the 200 series. This embodiment is especially suited for installations where speed is not an essential.

In FIG. 10 the frame is again designated by the symbol F (see the lower right) and is seen to support a 4-bar linkage generally designated 200. The linkage includes a first bar 221, a second bar 234, a third bar 224 and a fourth bar 225. The first bar 221 in this second embodiment is to the left—as contrasted to the first embodiment where the first bar 121 is to the right in FIG. 6. We designate the bars "first" because these are the ones coupled to the skew arms SA in FIGS. 6 and 10A.

As seen in FIG. 10A, these bars are pivotally interconnected at what might be considered the corners of the parallelogram as at 226 connecting the first bar 221 with the third bar 224. Another pivotal connection is designated 228 connecting the third bar 224 with the second bar 234. A pivotal connection similar to that at 228 is designated 229 and this is at the lower right portion of the 4-bar linkage 200 connecting the fourth bar 225 with the second bar 234. Lastly, the pivot connection 227 which is the same as the connection 226 couples the first bar 221 with the fourth bar 225.

Although the invention has been described in conjunction with the usual two bladed continuous motion saw, it will be appreciated that the advantages of the invention may be applied to saws with one, three or four blades inasmuch as the invention permits a balancing of forces through the geometry of the controlling linkage. With a single blade, for example, a suitable counterweight is provided on the bar or arm end lacking the blade.

The frame F supports a bearing 260 (compare the central part of FIG. 11 with the right hand part of FIG. 10) which in turn rotatably supports a shaft 261 (seen in the central right portion of FIG. 10). The shaft 261 at its extreme right end is equipped with a rotary union 262. This permits pneumatic power to be sent to the grinders for cycling them on and off. As seen in FIG. 10A, the shaft 261, intermediate its ends, is pivotally coupled as at 263 to the second bar 234 and at its left end coupled to the first bar 221 at 264.

The 4-bar linkage 200 is also indirectly supported by the frame via the skew arm SA. This can be appreciated by first considering the extreme lower left hand portion of FIG. 10 where a portion of the frame is designated F' and is seen to carry a bracket 265. As can be seen in FIG. 10A, the bracket 265 carries a gear box 266 driven by a motor (not shown). Coupled to the output of the gear box 266 is a shaft 267 which is also supported on the bracket 265 by a bearing member 268. The shaft 267 carries at its right hand end—as at 267*a*—the skew arm SA. As can be appreciated from FIG. 12, the skew arm SA is positioned between the spaced apart portions 221*a* and 221*b* making up the first bar 221. FIG. 12 also shows the drive generally designated 269 for the blades D, D'—see also FIGS. 10A and 13.

Referring specifically to FIG. 10A, the relatively elongated skew arm SA is equipped with couplings 270 at the upper and lower ends. Only that adjacent the upper end is designated. However, it will be appreciated that each of skew arm SA and bars 221 and 234 is symmetrical about a mid-plane.

Each coupling 270 in turn provides a housing for a pivot shaft 271. The housings of the couplings 270 additionally are fixed to the first bar 221 while the pivot shafts 271 are fixed to the skew arm SA. So as the skew arm SA rotates with the first bar 221 there is free pivotal movement of the first bar 221 relative to the skew arm SA.

Each of the third and fourth bars 224, 225 has a power end and a work end—these relating to the left and right ends, respectively, as shown in FIG. 10A. At the power end of the third bar 224, for example, there is provided the drive 269 which through an intermediate shaft 272 drives the upper disc blade D. Power is derived from motor 273—see FIG. 10A at the lower left. A similar arrangement 272' is provided relative to the fourth bar 225 for driving the lower disc blade D' and which is provided at an extension of the fourth bar 225.

Operation

In operation, the 4-bar linkage 200 rotates to bring the upper disc blade D downwardly through an arc of 180° to the position of the lower disc blade D'. As the linkage passes through the 90° part of its cycle, the two disc blades D, D' are transversely aligned. The shaft 261 and the connections thereof to the first and second bars 221, 234 as at 264 and 263, respectively, are responsible for skew compensation and to maintain the orientation of the disc blades perpendicular to the web plies in the linear path when severing the same. In other words, the skew angle again provides for the movement of the blades D, D' in the direction of movement of the material to be cut. However, for the cut to be acceptable, the blades D, D' have to be exactly perpendicular to the path of travel of the product and this is what is achieved through the shaft 261 and its connections as at 263, 264 to the second and first bars.

More particularly, the skew arm SA drives the first bar 221 through the couplings 270. The first bar 221 then drives the shaft 261 and also drives the third and fourth bars 224 and 225. These, in turn, drive the second bar 234. However, the fixing of the shaft 261 within the bearing 260 applies a modulation to the 4-bar linkage 200 to, at all times, maintain the blades D, D' perpendicular to the material being cut—in the path P which is parallel to the axis of shaft 261.

The cut length can be changed by changing the skew angle between the shaft 267 which drives the skew arm SA and the shaft 261. This is achieved advantageously in the illustrated embodiment by providing slots 274 in the bracket 265 and securing the bracket in a desired position by tightening the nut-bolt coupling 275—see the central left portion of FIG. 10A.

By driving the 4-bar linkage 200 from the shaft 267 a more steady angular velocity is provided the linkage 200 than would result from driving shaft 261. The latter would cause a speed pulsation of the 4-bar linkage 200. This occurs, for example, because the perpendicular distance from the center line of the shaft 261 to the center line of the third bar 224 changes through the orbit. In contrast, the relationship of a center line of the shaft 267 to the third bar 224 and fourth bar 225 does not change through the orbit—so pulsation is avoided.

Also, in the illustration given, each of the connections between the upper and lower portions of drive 269 and the intermediate shafts 272, 272' is advantageously a constant velocity universal joint 276—see FIG. 13A. A suitable joint is available from CON-VEL, INC. located in Summerville, S.C. This joint—as contrasted to a universal joint, i.e., a Cardan joint—insures that any velocity pulsation effects due to oscillation of the third bar relative to the first bar 221 or oscillation of the first bar 221 relative to the skew arm SA will not affect the speed of the blades D, D'.

Also in FIG. 13A, the other elements previously referred to are identified, viz., drive 269, skew arm SA, the spaced apart portions 221*a*, 221*b* of first bar 221, pivotal connection 226 between bars 221 and 224, shaft 272 and blade D. Also shown are the spaced apart portions 234*a* and 234*b* of the second bar 234. As indicated previously the second bar 234 is pivotally connected to the third bar 224 by the pivot 228—see the right hand portion of both FIGS. 10A and 13A.

As with the first embodiment, the blades D, D' are equipped with grinding stones as at $G_i$. These are inward at all times, i.e., within the orbit OR defined by the centers or revolution axes of the blades D, D'—see FIG. 1. This aids in reducing the centrifugal loading. To accommodate these, the second bar 234 is angled to provide a somewhat convex attitude relative to the first bar 221. A suitable drive and control for the operation of the stones can be seen in above-mentioned co-owned U.S. Pat. No. 5,152,203. This and the other patent mentioned hereinbefore U.S. Pat. No. 4,347,771 were specifically designed for application to the CM saw of patent '813. For that, a controller CR is provided on the machine frame—see FIG. 1. The controller regulates the plunging motion via air cylinder 279. The plunging motion causes both stones to simultaneously contact the disc blade. The adjustment motion occurs as the diameter of the blade diminishes throughout its life cycle.

The invention here also makes use of guards as at 277 relative to the upper disc blade D—see FIG. 11A. Only a portion 277' is shown in FIG. 11A relative to the lower blade D'. Each guard, however, is interrupted as at 278 (in the upper part of FIG. 11A) to permit radially inward movement of the stones $G_i$. When the blade is new—as at D' in the lower part of FIG. 11A, the stones $G_i$ are most removed from the blade axis, i.e., the axis of shaft 272. Then, as the blade becomes duller, grinding occurs, resulting in diameter reduction, so the air cylinder arrangement 279 is also actuated to move the stone supporting bracket closer to the axis of the shaft 272 (or 272').

Summary

The inventive method of operating an orbital saw for transversely severing elongated superposed, multi-ply web material such as logs of convolutely wound material (FIG. 3) and/or stacked tissue or the like (FIG. 4) includes the following steps and structure:

providing a frame F defining a linear path P for advancing along a linear path superposed elongated web plies having a cross-sectional area of at least about 3.5 $in^2$ (2200 $mm^2$), providing a 4-bar linkage 20, 120, 200 including first and second bars 21, 34, 121, 134, 221, 234 extending generally parallel to each other and third and fourth bars 24, 25, 124, 125, 224, 225 connecting the first and second bars adjacent the ends thereof, further providing disc blades D, D' rotatably mounted on each of the third and fourth bars with each of the third and fourth bars being equipped with a drive 144, 269 for rotating the disc blades, rotating the first bar about a first shaft axis 136, 267 to orbit the blades with the blade orbit intersecting the linear path with the centers of the disc blades being at least 30 inches (750 mm) apart while skewing the first axis at a minor acute angle θ to the linear path, connecting the first and the second bars with the third and fourth bars to provide at least one degree of pivotal freedom of the third and fourth bars relative to the first and second bars, and rotating the second bar about a second shaft axis 150, 261 different from the first axis to compensate for the skewing and to orient the disc blades perpendicular to the web plies in the linear path when severing the web plies. The invention finds advantageous where the superposed web plies (either log L or stacked plies ST) have a cross sectional area of at least 3.5 square inches (2200 $mm^2$).

The inventive method also includes relative to the first embodiment the further step of offsetting the second axis E from the first axis S and extending the second axis parallel to the first axis. This includes, more particularly, changes to the offset of the second axis relative to the first axis to change the spacing of consecutive cuts along the linear path P.

Relative to the second embodiment, the invention includes the further step of intersecting the second axis 261 with the first axis 267 at a minor acute angle. Also relative to the second embodiment, the rotating means therein includes orbiting the blades at a substantially constant angular velocity and this is achieved by connecting the drive means via the gear box 266, to the skew arm SA. Also connected to the skew arm SA is the first arm 221. The second embodiment also includes the step of rotating the blades D, D' independently of rotating the first and second bar means 221, 234—using a separate motor 273 for rotating the blades.

As to the latter function—rotating the blades, the inventive method includes the further step of providing constant velocity universal joint means 276 connecting drive 269 to blade shaft 272 to compensate for all velocity fluctuations caused by oscillation of the third and fourth bars 224, 225 relative to the skew arm SA.

According to the invention, a variety of products can be advantageously, transversely severed. Generally, the products are all superposed elongated web plies and the different forms are convolutely wound logs of bathroom tissue or kitchen toweling and/or interfolded plies.

Still further, the invention provides an advantageous apparatus as embodied in the depiction of FIGS. 10–13A. There is seen a continuous motion saw for transversely severing superposed web plies into shorter length products which includes a frame F providing a linear path P for the superposed web plies, conveying means C operably associated with the frame for advancing the superposed web plies along the linear path, a first shaft 267 mounted on the frame for rotation about an axis S extending at a minor acute angle θ to the linear path P, means for adjusting angle θ by relocating shaft 267 while still maintaining axial alignment with pivot 264 thereby changing the spacing of consecutive cuts and maintaining blade perpendicularity with the linear path P, means 266 on the frame for rotating the first shaft, a skew arm SA mounted on the first shaft, a second shaft 261 mounted on the frame for rotation about an axis in shaft 261 extending parallel to the linear path P, a 4-bar parallelogram linkage 220 including first and second bars 221, 234 extending generally parallel to each other and pivotally connected at their ends to third and fourth bars 224, 225, means rotatably coupling both of the first and second bars intermediate the ends thereof to the second shaft 261, means 270, 271 pivotally coupling the first bar adjacent the ends thereof to the skew arm, each of said third and fourth bars 224, 225 extending beyond the pivotal connection thereof with the first and second bars to provide a power end and a work end, a disc blade D, D' rotatably mounted on the work end of each third and fourth bar and a drive means 269 coupled to the power end of each third and fourth bar to rotate the disc blades independently of the rotation of the 4-bar linkage.

Advantageous additional features of the invention in the second embodiment are the interposition of a constant velocity joint 276 between the blade drive 269 and the blade/blades D, D'. Another advantageous drive feature is to drive the first bar 221 rather than the second bar 234.

While in the foregoing specification a detailed description of embodiments of the invention have been set down for the purpose of illustration and compliance with the statute, many variations in the details hereingiven may be made by those skilled in the art without departing from the spirit and scope of the invention.

What is claimed is:

1. A method of operating an orbital saw to transversely sever superposed elongated web plies into shorter length products comprising the steps of advancing, along a linear path, said superposed elongated web plies having a cross sectional area of at least about 3.5 square inches (2200 $mm^2$), providing a 4-bar linkage including first and second bars extending generally parallel to each other, each of said first and second bars having a pair of ends, and third and fourth bars to provide at least one degree of pivotal freedom of said third and fourth bars relative to said first and second bars, connecting said first and second bars adjacent the ends thereof with said third and fourth bars, rotatably mounting a disc blade having a center on each of said third and fourth bars with each of said third and fourth bars being equipped with means for rotating said disc blades, rotating said first bar about a first axis to orbit said blades with the orbit of said blades intersecting said linear path and with the centers of said disc blades being at least 30" (750 mm) apart while skewing said first axis at a minor acute angle to said linear path, and rotating said second bar about a second axis different from said first axis to compensate for said skewing and to orient said disc blades perpendicular to said web plies in said linear path when severing said web plies.

2. The method of claim 1 in which said method comprises a further step of offsetting said second axis from said first axis and extending said second axis parallel to said first axis.

3. The method of claim 2 in which said shorter length products have a length and the method comprises a further step of changing the offset of said second axis relative to said first axis to change the length of said shorter length products.

4. The method of claim 1 in which said method comprises a further step of intersecting said second axis with said first axis at a minor acute angle.

5. The method of claim 1 in which said step of rotating the first bar orbits the blades at a substantially constant angular velocity.

6. The method of claim 5 in which said step of rotating the first bar comprises connecting drive means to the first bar rather than to the second, third, or fourth bars, whereby rotation of the first bar rotates the second, third, and fourth bars.

7. The method of claim 6 in which said step of connecting drive means comprises connecting a skew arm to the first bar and connecting said drive means to the skew arm.

8. The method of claim 1 in which said blades are rotated independently of rotating said first bar.

9. The method of claim 1 in which said first and third bars have a connection therebetween and said first and fourth bars have a connection therebetween and said method also includes connecting a constant velocity universal joint to one of said blades at the connection between the third bar and the first bar and connecting a constant velocity universal joint to the other of said blades at the connection between the fourth bar and the first bar.

10. The method of claim 1 in which said step of advancing superposed elongated web plies comprises introducing sequentially convolutely wound logs.

11. The method of claim 10 in which the method also includes transversely severing said logs into bathroom tissue lengths.

12. The method of claim 10 in which the method also includes transversely severing said logs into kitchen toweling lengths.

13. The method of claim 1 in which said step of advancing superposed elongated web plies comprises advancing continuously interfolded plies.

* * * * *